United States Patent [19]

Gill

[11] 4,393,906

[45] Jul. 19, 1983

[54] STERN TO BOW OFFSHORE LOADING SYSTEM

[75] Inventor: William A. Gill, El Toro, Calif.

[73] Assignee: FMC Corporation, Chicago, Ill.

[21] Appl. No.: 246,565

[22] Filed: Mar. 23, 1981

Related U.S. Application Data

[63] Continuation of Ser. No. 80,369, Oct. 1, 1979, abandoned.

[51] Int. Cl.[3] ..... B65B 3/04

[52] U.S. Cl. ..... 141/387; 137/615; 414/137

[58] Field of Search ..... 141/284, 279, 387, 388; 137/615; 414/137–140

[56] References Cited

U.S. PATENT DOCUMENTS

| | | | |
|---|---|---|---|
| 3,455,333 | 7/1969 | Bily | 141/387 X |
| 3,675,680 | 7/1972 | Frohlich | 137/615 |
| 4,121,616 | 10/1978 | Lochte et al. | 141/387 |
| 4,125,195 | 11/1978 | Sasadi | 141/387 X |
| 4,202,372 | 5/1980 | Gibbons | 141/387 |
| 4,261,398 | 4/1981 | Haley | 141/387 |
| 4,276,917 | 7/1981 | Fujita | 141/387 |

FOREIGN PATENT DOCUMENTS

| | | | |
|---|---|---|---|
| 295192 | 5/1966 | Australia | 141/387 |

*Primary Examiner*—Houston S. Bell, Jr.

*Attorney, Agent, or Firm*—L. B. Guernsey; W. W. Ritt, Jr.

[57] ABSTRACT

An offshore loading system especially suited for transferring petroleum products from a floating production vessel to a marine tanker. The system comprises a cantilevered support boom mounted on the deck of the production vessel, a fluid conduit extending generally horizontally along the boom from a riser on the deck of the production vessel, an articulated loading arm connected to the outboard end of the horizontal conduit, and a multiple swivel joint for connection between the outboard end of the loading arm and a pipe manifold on the deck of the marine tanker. The inboard end of the loading arm is connected by swivel joints to the outboard end of the horizontal conduit to facilitate pivoting the loading arm in both a vertical plane and a horizontal plane. An inboard drive sheave secured to the inboard end of the loading arm is connected to a support cable for raising and lowering the arm, and a pantograph drive system of sheaves, cables and hydraulic cylinders interconnects the inboard drive sheave and an outboard sheave for raising and lowering an outboard section of the arm.

8 Claims, 4 Drawing Figures

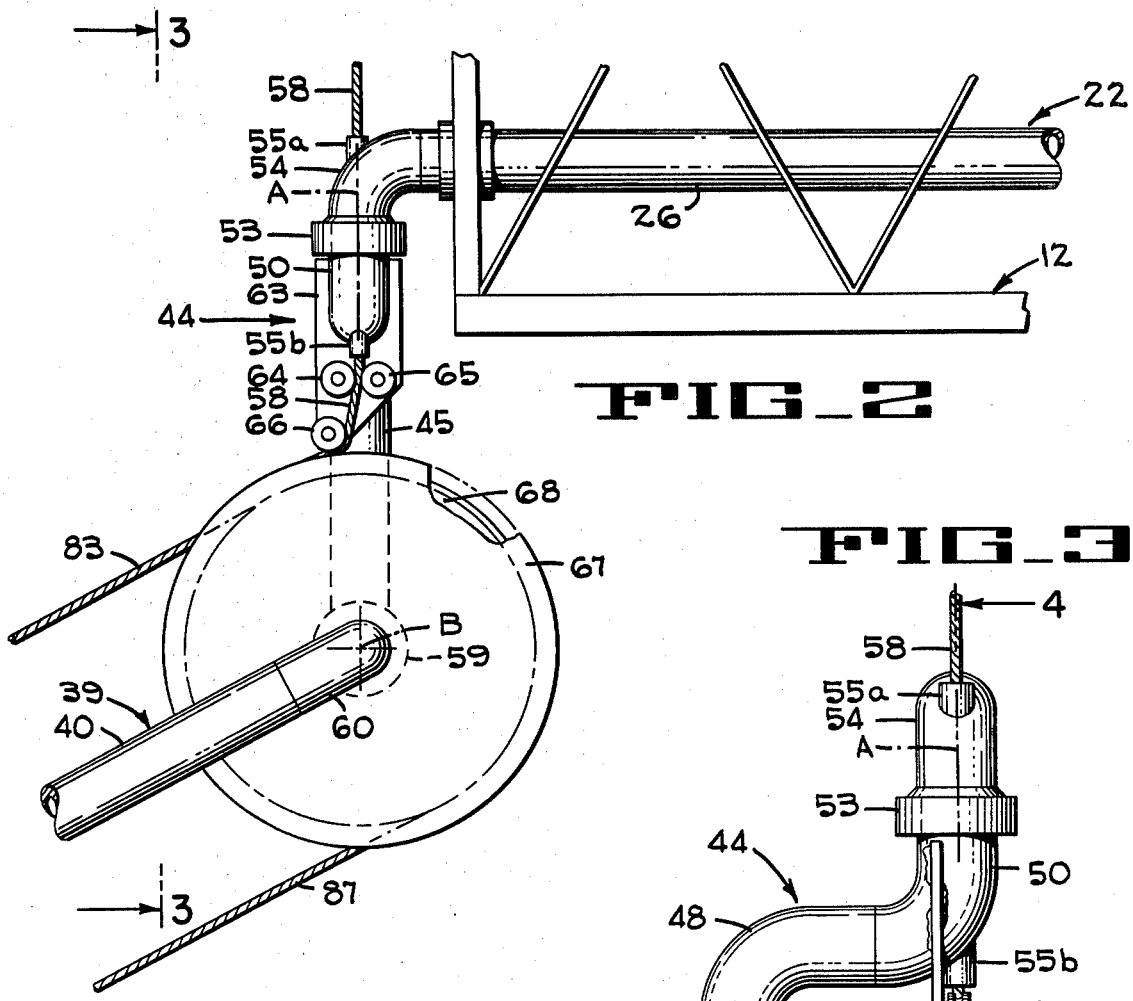
FIG_2
FIG_3
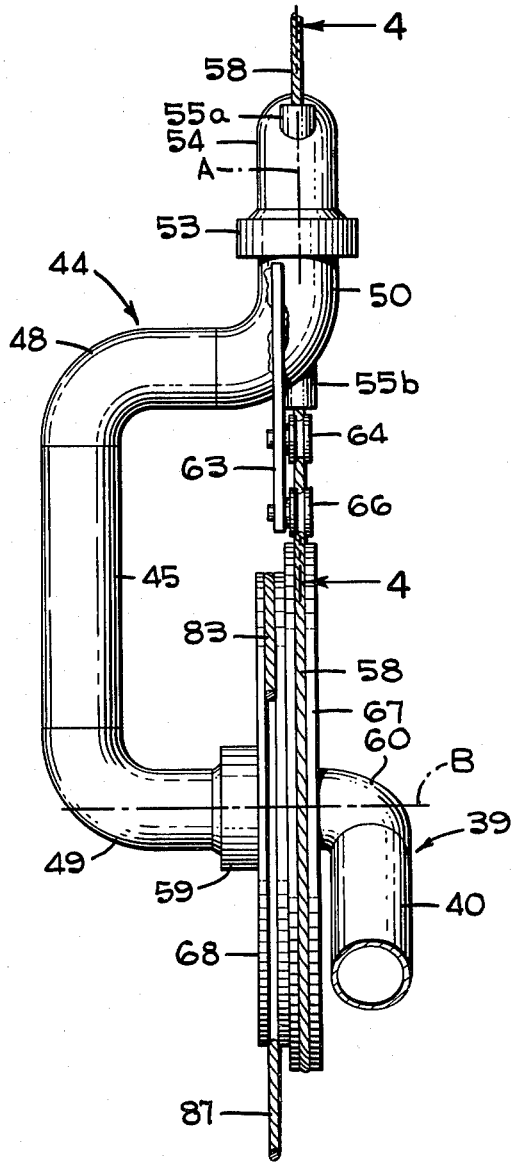
FIG_4
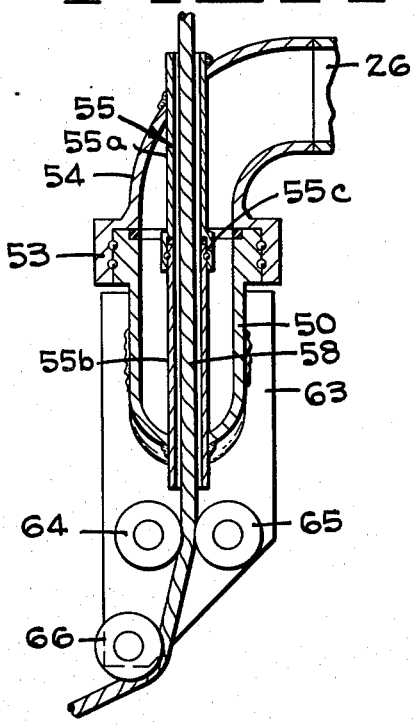

STERN TO BOW OFFSHORE LOADING SYSTEM

This is a continuation of application Ser. No. 080,369, filed Oct. 1, 1979, now abandoned.

BACKGROUND OF THE INVENTION

1. Field of the Invention

This invention relates to fluid loading systems, and more particularly to marine loading arms for transferring the fluid between a floating production vessel and a marine tanker.

2. Description of the Prior Art

The production of oil and gas from offshore wells has developed into a major endeavor of the petroleum industry, and this growth has lead to the development of means for transporting petroleum products from offshore wells to shore based refineries or storage facilities. Many of the wells are being drilled and completed in deep-water locations where the oil fields are too small to justify the work and expense of installing a permanent production/processing platform. In many of these locations a floating production vessel, constructed of a tanker which has been specially modified, is yoked to a single point mooring facility at the oil field. The crude petroleum is transferred from the production vessel to a shuttle tanker which transports the petroleum to shore based storage and/or refinery facilities. In some of the larger fields a similar production vessel is used in order to start production of petroleum while the permanent platforms are being built. In either case the production vessel is secured, bow on, to the single point mooring or to a buoy by mooring lines that permit the vessel to swing freely according to the dictates of wind and current and the shuttle tanker is positioned with its bow adjacent the stern of the production vessel. The tanker may be secured to the production vessel by mooring lines, and/or thrusters may be used to hold the tanker in position near the production vessel during the loading operation.

The production vessel and the tanker move relative to each other during the loading operation due to waves, winds, currents, and the amount of cargo which is transferred into the tanker. The height of the tanker and the height of the production vessel above the water line change as the tanker is being loaded, thus requiring that a flexible or articulated hose be used in this procedure. When flexible hoses are used, a tender is normally required to assist in picking up the hose for connection to the tanker's manifold. Such an arrangement not only requires the use of a tender, but movement of the tanker may cause the flexible hose to be broken. Also, such hoses are bulky, heavy, hard to handle, and require a relatively large crew of workers to make up the connection to the tanker.

What is needed is an articulated loading arm which can be mounted on or near the stern of the production vessel from where it can reach the bow of the tanker, which has means to adequately compensate for relative movement between the tanker and the production vessel, and which is fully counterbalanced in all operating as well as stowed positions.

SUMMARY OF THE INVENTION

The present invention comprises an offshore loading system especially designed for transferring LNG (liquefied natural gas) and other fluids from one floating vessel to another, and particularly from a floating production or storage vessel to a marine transport tanker. This invention overcomes some of the disadvantages of the prior art by employing a tower or other suitable vertical support structure mounted on the production vessel, a generally horizontally-disposed pipe-supporting boom connected at or near its inboard end to the tower and extending towards the tanker mooring site, an articulated fluid loading arm extending from the outboard end of the boom for connection to the tanker, a first sheave and cable assembly for controlling the pivotal movement of the arm's outboard section about the horizontal axis through its connection to the inboard arm section, and a second sheave and cable assembly for controlling pivotal movement of the entire loading arm about the horizontal axis through its connection to the boom supported piping. The second sheave and cable assembly includes a first sheave mounted on and fixed to the inner end of the inboard arm section for pivotal movement with that arm section about the horizontal axis through its connection to the boom-supported piping, a second sheave mounted on the outer end of the boom for rotation about a horizontal axis parallel to the first sheave's axis, a counterweight mounted on the tower for pivotal movement about a horizontal axis, and a cable extending from the first sheave and over the second sheave to the counterweight, so that the loading arm is counterbalanced about the axis through its connection to the boom piping by the counterweight.

BRIEF DESCRIPTION OF THE DRAWINGS

FIG. 2 is an enlarged fragmentary side elevation of the offshore loading system shown in FIG. 1.

FIG. 3 is an enlarged vertical section taken along line 3—3 of FIG. 2.

FIG. 4 is an enlarged central section taken along the line 4—4 of FIG. 3.

DESCRIPTION OF THE PREFERRED EMBODIMENT

Figure 1:
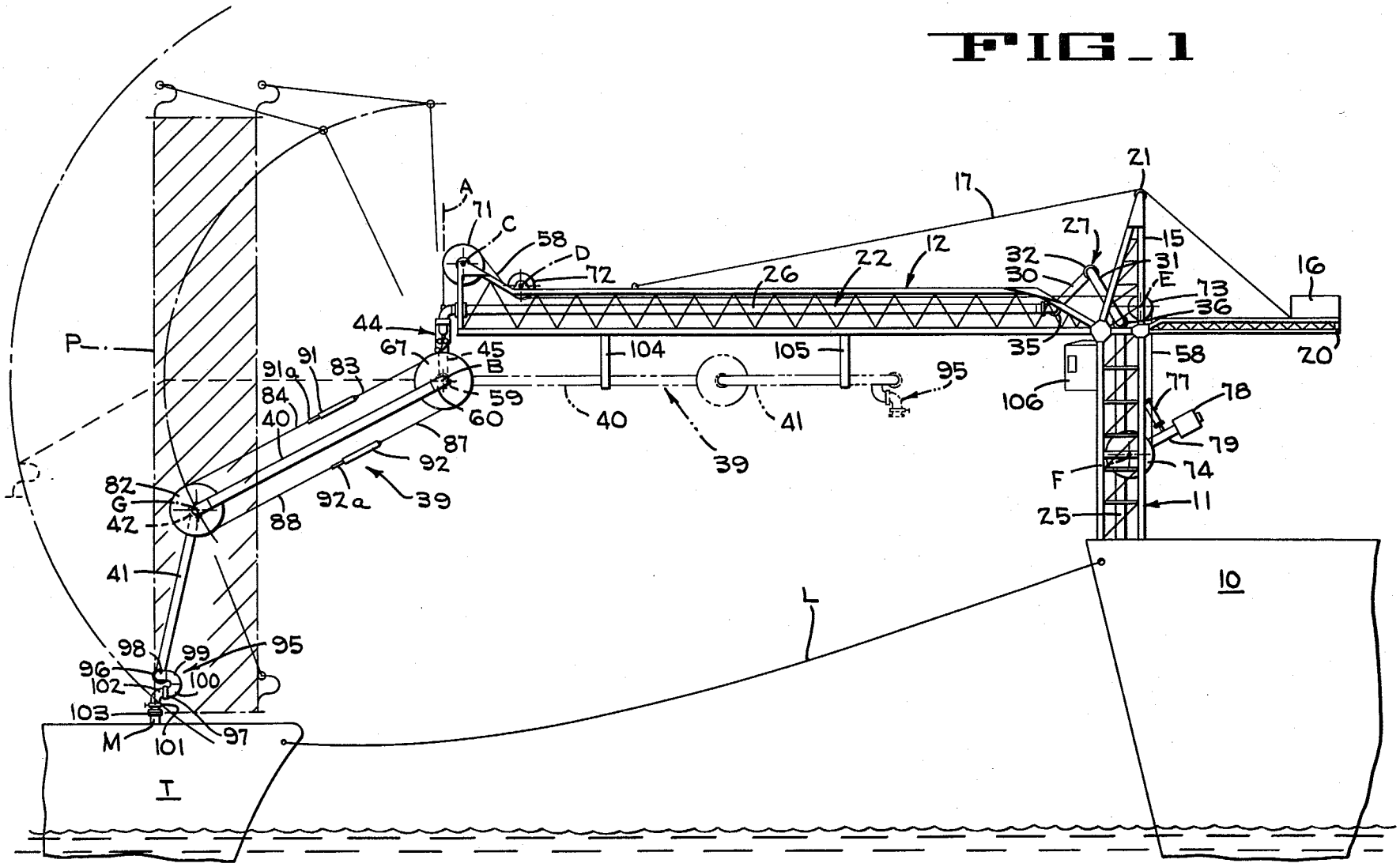
FIG. 1 is a side elevation of a stern-to-bow offshore loading system according to the present invention, with the articulated loading arm shown connected in operating position to a marine tanker.

An offshore stern-to-bow loading system for transferring LNG or other petroleum fluids from a floating production vessel 10 to a marine tanker T is illustrated in FIG. 1 with details shown in FIGS. 2–4. The tanker T is secured to the production vessel 10 by one or more mooring lines L that permit the tanker to move according to the dictates of wind and current, and yet hold the tanker a proper distance from the production vessel to facilitate the transfer of fluid through the loading system.

The loading system comprises a tower or other suitable support structure 11 (FIG. 1) mounted on the deck of the production vessel 10 and having a generally horizontally-disposed support boom 12 connected at or near the inboard end thereof to the tower 11. The support boom 12 is retained in the substantially horizontal position by a mast 15, a counterweight 16, and a boom support cable 17. The support boom 12, a counterweight boom 20, and the mast 15 are rigidly connected to the tower 11. The boom support cable 17 is trained over a mast sheave 21 mounted at the top of the mast 15, and extends between the counterweight 16 and the outer portion of the support boom 12. Thus the counterweight 16 balances the weight of the support beam 12 and reduces the strain on the tower 11.

A pipe assembly 22 (FIG. 1) includes a vertical fluid supply conduit 25 extending downward through the tower 11 and the deck of the vessel 10 to a fluid source (not shown), and a generally horizontal boom conduit 26 supported by the boom 12. A jumper assembly 27, comprising a pair of conduit members 30,31 interconnected by a swivel joint 32, interconnects the boom conduit 26 and the vertical conduit 25 by two pipe swivel joints 35,36, respectively. The jumper assembly 27 accommodates any axial movement of the inboard end of the boom conduit 26 due to thermally caused expansion or contraction.

An articulated loading arm 39 (FIG. 1) at the outboard end of the boom 12 compensates for both horizontal and vertical movement of the tanker T relative to the production vessel 10. Relative horizontal movement between the tanker T and the production vessel 10 is usually fairly small due to the restraints imposed by the mooring line L and/or the operation of the thrusters of the tanker. Due to size differences of various tankers and the changes in height of a tanker above the waterline as it is being loaded, the relative heights of the tanker T and the vessel 10 may vary over a wide range. To accommodate these relative position variations the operating area or envelope P of the loading arm 39 must be tall and narrow as shown by the shaded area in FIG. 1.

The loading arm 39 comprises an inboard conduit section 40 and an outboard conduit section 41 interconnected by a pipe swivel joint 42 for relative pivotal movement about a horizontal axis G. The inboard section 40 is connected to the outer end of the boom conduit 26 by an articulated conduit assembly 44 which allows the arm to pivot about a vertical axis A and a horizontal axis B. The conduit assembly 44 includes a relatively short conduit 45 (FIG. 3), two 90-degree elbows 48,50 and a pipe swivel joint 53 that connect the assembly to a 90-degree elbow 54 on the outer end of the boom conduit 26, and another 90-degree pipe elbow 49 and a pipe swivel joint 59 that connect the assembly to a 90-degree pipe elbow 60 on the inner end of the loading arm's inboard section 40. The swivel joint 53 allows the loading arm 39 to pivot in a horizontal plane about a vertical axis A, and the swivel joint 59 facilitates pivotal movement of the arm in a vertical plane about a horizontal axis B.

The outboard arm section 41 carries at its outer end a triple pipe swivel joint assembly 95 (FIG. 1) to provide an articulated connection between the arm and the tanker T. This assembly can comprise first and second swivel joints 96,97 interconnected by three pipe elbows 98,99, and 100, and a third swivel joint 101 interconnected by a fourth pipe elbow 102 to the second swivel joint 97. This assembly also can include a terminal pipe flange 103 that provides a means for releasably connecting the arm to the tanker's manifold M, a connection that can be achieved by a suitable coupler mechanism (not shown) mounted on the manifold. The assembly 95 also can include a flow control valve (not shown) suitably located to control flow through the arm. Thus, the swivel joint assembly 95 enables the loading arm 39 to follow and accommodate to the movements of the marine tanker T relative to the production vessel 10 so that vessel-to-vessel fluid transfer at sea can be safely and efficiently completed.

As illustrated in FIGS. 1 and 3, the outboard section 41 of the loading arm 39 is pivoted relative to the inboard section 40 about the horizontal axis G by means of a sheave and cable pantograph assembly comprising sheaves 68 and 82, cables 83,84,87 and 88, and hydraulic cylinders 91,92. The sheave 68 (FIG. 3) is fixed to the elbow 60 coaxial with the axis B, and the sheave 82 is fixed to the outboard section 41 coaxial with the axis G. A portion of each of the cables 83,87 is trained around the sheave 68, and the inner ends of both cables are secured to this sheave. In a like manner, each of the cables 84,88 is trained around and secured to the sheave 82. The cylinders 91 and 92 are attached to the outer ends of the cables 83,87 and the rods **91*a*,92*a* of the cylinders 91,92 are attached to the inner ends of the cables 84,88, respectively. Accordingly, when the piston rod 91*a* is retracted into its cylinder 91, and simultaneously therewith the piston rod 92*a* is extended from its cylinder 92, the sheave 82 and the outboard section 41 are pivoted clockwise around the axis G as viewed in FIG. 1, i.e., the outboard section 41 is elevated. Correspondingly, the outboard section 41 is lowered, i.e., pivots counterclockwise about the axis G, when the piston rod 91*a* is extended and the piston rod 92*a*** is retracted.

Pivotal movement of the loading arm 39 about the horizontal axis B is accomplished and controlled by a second sheave and cable assembly comprising an arm sheave 67 (FIGS. 1–3) that is welded or otherwise fixed to the elbow 60 of the inboard arm section 40, a counterweight 78 supported on a beam 79 that is fixed to and extends from a counterweight sheave 74 that is pivotally mounted on the tower 11 for rotation about a horizontal axis F, a cable 58 trained around and secured to the sheaves 67,74, and a plurality of idler sheaves 71–73 pivotally mounted on the boom 12 for rotation about horizontal axes C, D and E, respectively, to maintain the cable 58 is a preselected location between the sheaves 67,74. A hydraulic cylinder 77, connected between the counterweight beam 79 and the tower 11, functions to rotate the counterweight 78, the beam 79, and the sheave 74 about the axis F, and thus by means of the cable 58 to simultaneously rotate the sheave 67, thereby powering the loading arm about the axis B as desired.

As seen best in FIGS. 2–4, the second sheave and cable assembly also includes a plurality of idler sheaves 64–66 pivotally mounted on a support bracket 63 that is welded or otherwise fixed to the elbow 50, for guiding the cable 58 between the sheaves 67 and 71. In order that the loading arm can pivot about the vertical axis A without restriction, this second sheave and cable assembly further includes an articulated tubular assembly 55, (FIG. 4) comprising an upper tubular element **55*a*, a lower tubular element 55*b*, and a pipe swivel joint 55*c* interconnecting the elements 55*a*, 55*b*. This tubular assembly 55 extends vertically through the elbows 54,50 coaxial with the swivel joint 53, and thus with the axis A. The portion of the cable 58 extending through the assembly 55 is maintained coaxial therewith, and therefore also with the axis A, by the idler sheaves 64,65 and 71, whereby this portion of the cable can twist to allow the arm to slew about the axis A, the twist compensating for the slewing motion without changing the balance of the arm. If this twist is found to be undesirable, particularly the large degree of twist encountered when the arm is slewed into the stored position indicated in phantom in FIG. 1**, a swivel can be included in this portion of the cable.

The loading arm 39 can be slewed approximately 180 degrees about the vertical axis A, away from the working position shown in the solid lines (FIG. 1), and the sheave 74 rotated clockwise to raise the arm into the stored position shown in the phantom lines were the arm rests against a pair of brackets 104,105 mounted on the lower side of the boom 12. The operation of the loading arm can be controlled from a control cab 106 positioned near the upper end of the tower 11. Hydraulic lines (not shown) extend from the control cab 106 to each of the hydraulic cylinders 77,91 and 92 provide control of raising and lowering the inboard and outboard sections of the loading arm.

The present invention provides a cantilevered boom which extends from the stern of a production vessel to the bow of a tanker or other marine vessel, and an articulated loading arm connected to the outboard end of the boom for movement in both vertical and horizontal planes to facilitate an easy connection of the arm to a manifold on the tanker. Hydraulic cylinders provide individual control of the attitude of both the inboard and outboard sections of the arm, and the arm and the universal joint means between it and the boom provide for free relative movement between the two vessels.

Although the best mode contemplated for carrying out the present invention has been herein shown and described, it will be apparent that modification and variation may be made without departing from what is regarded to be the subject matter of the invention.

What is claimed is:

1. A loading system for transferring fluid from one fluid handling means to another and to provide for relative movement between the different handling means, said system comprising:

a support structure for mounting on a first fluid handling means;

a horizontal support boom having an inboard end connected to said support structure;

a boom conduit member mounted along said boom;

means for coupling the inboard end of said boom conduit member to said first handling means;

an articulated loading arm having one end thereof pivotally connected to the outer end of said boom conduit member for movement about a first horizontal axis;

an inboard sheave;

means for mounting said inboard sheave for rotation about said first horizontal axis with said inboard sheave fixed to said loading arm;

a tower sheave rotatably mounted on said support structure;

a loading arm support cable;

means for connecting said support cable between said inboard sheave and said tower sheave including a plurality of idler sheaves, means for pivotally mounting a first idler sheave on the outer end of said support boom adjacent said inboard sheave, means for mounting a second idler adjacent said tower sheave, means for connecting a first end of said support cable to said inboard sheave, said support cable being trained around said inboard sheave and trained around a portion of said first and said second idler sheaves, and means for connecting a second end of said support cable to said tower sheave;

means for rotating said tower sheave to rotate said inboard sheave and to pivotally move said loading arm about said first horizontal axis; and means for connecting the outboard end of said loading arm to a second fluid handling means.

2. A loading system as defined in claim 1 including means for pivotally connecting said one end of said loading arm to the outer end of said boom conduit member for movement about a vertical axis.

3. A loading system as defined in claim 1 wherein said means for rotating said tower sheave includes a hydraulic ram and means for connecting said hydraulic ram between said tower and said tower sheave.

4. A loading system for transferring fluid from one fluid handling means to another and to provide for relative movement between the different handling means, said system comprising:

a support structure for mounting on a first fluid handling means;

a horizontal support boom having an inboard end connected to said support structure;

a vertical conduit member having one end thereof connected to said first handling means;

a boom conduit member mounted along said boom with the inner end of said conduit member connected to the other end of said vertical conduit member;

an articulated loading arm having one end thereof pivotally connected to the outer end of said boom conduit member for movement about a first horizontal axis;

an inboard sheave;

means for mounting said inboard sheave for rotation about said first horizontal axis with said inboard sheave fixed to said loading arm to rotate said loading arm about said first horizontal axis;

a tower sheave rotatably mounted on said support structure;

a loading arm support cable;

means for connecting said support cable between said inboard sheave and said tower sheave;

means for pivotally connecting said one end of said loading arm to the outer end of said boom conduit member for movement about a vertical axis;

means for guiding said support cable along a path coincident with said vertical axis to facilitate movement of said loading arm about said vertical axis;

means for rotating said tower sheave to rotate said inboard sheave and to pivotally move said loading arm about said first horizontal axis; and means for connecting the outboard end of said loading arm to a second fluid handling means.

5. A loading system as defined in claim 4 including a plurality of idler sheaves, means for pivotally mounting said idler sheaves on said support boom and said support structure to provide a guide path for said support cable between said inboard sheave and said tower sheave.

6. A loading system for transferring fluid from a supply conduit on the stern of one floating vessel to a tanker manifold on the bow of another floating vessel and to provide for relative movement between the two vessels, said system comprising:

a support structure for mounting on the stern portion of said one floating vessel;

a horizontal support boom having an inboard end connected to said support structure;

a boom conduit member mounted along said boom with the inboard end of said boom conduit member connected to said supply conduit;

an articulated loading arm having an inboard conduit member and an outboard conduit member;

a universal joint means connected between the inboard end of said loading arm and the outboard end of said boom conduit member to provide pivotal movement of said loading arm about a vertical axis and pivotal movement about a first horizontal axis;

an inboard sheave and an outboard sheave;

means for mounting said inboard sheave rotatably about said first horizontal axis with said inboard sheave fixed to said inboard conduit member of said loading arm;

means for pivotally connecting the inboard end of said outboard conduit member to the outboard end of said inboard conduit member for movement of said outboard conduit member of said loading arm about a second horizontal axis;

means for mounting said outboard sheave for rotation about said second horizontal axis with said outboard sheave fixed to said outboard conduit member;

a loading arm support cable;

means for connecting one end of said support cable to said inboard sheave;

drive means connected between said support structure and the other end of said support cable to rotate said inboard sheave and to pivotally move said loading arm about said first horizontal axis;

power means connected between said inboard and said outboard sheaves to rotate said outboard sheave and said outboard conduit member about said second horizontal axis; and means for coupling the outboard end of said outboard conduit member to said tanker manifold on said other floating vessel.

7. A loading system as defined in claim 6 wherein said power means includes a pair of hydraulic cylinders, and means for connecting each of said hydraulic cylinders between said inboard sheave and said outboard sheave.

8. A loading system as defined in claim 6 wherein said drive means includes a tower sheave rotatably mounted on said support structure, means for connecting the other end of said support cable to said tower sheave, and means for rotating said tower sheave to rotate said inboard sheave.

* * * * *